US006528748B2

(12) United States Patent
Harris et al.

(10) Patent No.: US 6,528,748 B2
(45) Date of Patent: Mar. 4, 2003

(54) IN-LINE FLOW SWITCH ASSEMBLY INCLUDING MAGNETIC SENSITIVE PLUNGER AND MICROSWITCH ACTUATOR

(75) Inventors: Jaime Harris, Eagan, MN (US); Gary Brown, Faribault, MN (US); Steven Christensen, Farmington, MN (US)

(73) Assignee: GP Companies, Inc., Mendota Heights, MN (US)

( * ) Notice: Subject to any disclaimer, the term of this patent is extended or adjusted under 35 U.S.C. 154(b) by 0 days.

(21) Appl. No.: 09/874,832

(22) Filed: Jun. 5, 2001

(65) Prior Publication Data

US 2002/0185363 A1 Dec. 12, 2002

(51) Int. Cl.[7] ..... H01H 35/26; H01H 9/00

(52) U.S. Cl. ..... 200/81.9 M; 200/82 C; 200/82 E; 335/207

(58) Field of Search ..... 200/308–317, 200/81 R, 81.9 M, 81.9 R, 82 R, 82 E; 335/205–207

(56) References Cited

U.S. PATENT DOCUMENTS

| | | | | | |
|---|---|---|---|---|---|
| 3,397,372 | A | * | 8/1968 | Maxwell | 335/205 |
| 3,564,175 | A | * | 2/1971 | Cooper | 200/82 R |
| 3,611,220 | A | * | 10/1971 | Hoffman | 200/82 E |
| 3,766,779 | A | * | 10/1973 | Hoffman | 20/81.9 M X |
| 3,982,217 | A | | 9/1976 | Reynolds | 335/207 |
| 4,499,347 | A | * | 2/1985 | Richards | 200/81.9 M |
| 4,648,277 | A | * | 3/1987 | Obermann | 200/83 R |
| 4,791,254 | A | * | 12/1988 | Polverari | 200/81.9 M |
| 4,906,807 | A | | 3/1990 | Siebert et al. | 200/81.9 |
| 4,963,857 | A | * | 10/1990 | Sackett | 200/81.9 M |
| 5,055,641 | A | * | 10/1991 | Richards | 200/81.9 M |
| 5,262,752 | A | * | 11/1993 | Truong et al. | 337/363 |
| 5,529,460 | A | | 6/1996 | Eihausen et al. | 417/20 |
| 5,927,950 | A | | 7/1999 | Juvenal | 417/38 |

* cited by examiner

*Primary Examiner*—J. R. Scott
(74) *Attorney, Agent, or Firm*—Oppenheimer Wolff & Donnelly LLP

(57) ABSTRACT

A flow switch for a high pressure washing system or other flow-related system is disclosed. The flow switch switches from an open to a closed position in the presence of adequate flow in a water or other fluid-carrying pipe. The flow switch includes a housing with a tubular bore, an inlet port and an outlet port which allow fluid to flow through the housing. Within the housing is a plunger with an attached plunger magnet. The plunger is responsive to fluid flow. A sensor is situated proximate to the housing. A sensor magnet is placed in position near the sensor and opposes the plunger magnet. A third magnet (the alignment magnet) is placed proximate to the housing. When there is no flow within the housing, the plunger is at its rest position as the alignment magnet attracts the plunger magnet to correctly align and position the plunger within the housing. When a threshold rate of flow is present, the force from the flow overcomes the attractive force of the alignment and plunger magnets and the plunger is moved to its secondary position. In this position, the plunger magnet trips the sensor when it repels the sensor magnet. In some embodiments, a display unit visually indicates that the microswitch has been triggered.

8 Claims, 4 Drawing Sheets

IN-LINE FLOW SWITCH ASSEMBLY INCLUDING MAGNETIC SENSITIVE PLUNGER AND MICROSWITCH ACTUATOR

BACKGROUND OF THE INVENTION

The present invention generally relates to switches. In particular, the present invention relates to flow switches which are useful as a component of a high pressure washing system and other systems where the flow or stoppage of flow can be used to trigger an action.

In high pressure washing systems, water is heated in water heater tanks by burners. The burners must be regulated so that the water does not become too hot, otherwise the water heater tanks can be in danger of exploding. In the past, one method of regulating the water heating subsystem of a high pressure washing system was by using a pressure switch. A pressure switch flips between its "off" and "on" positions depending on whether there is pressure present in the water pipe leading out of the water heater tank. When pressure was present, the pressure switch allowed the burners to operate. When pressure was removed, the pressure switch turned off the burners.

Regulating the burners with a flow switch rather than a pressure switch is another method that is used in the industry. A flow switch senses flow rather than pressure. Thus, while a customer is using the washing system, a flow switch can sense the flow of water through the system and can turn on the burners during this time. When the customer releases the trigger on the washer's wand, the water flow ceases and the flow switch can be used to turn the burner off.

Many known flow switches in the high-pressure washing system industry are reed-type switches. In such a reed switch, a piston within a water pipe is spring loaded. While water is flowing through the pipe, the water pressure against the piston compresses the spring, causing the piston to be located at a certain position within the pipe. Once the water pressure is relieved, the piston is no longer pressed against the spring, and so the spring decompresses, moving the piston back to its resting position. The piston within the pipe is fitted with a magnet which interacts with a metal reed component of the reed switch. The reed switch sensor is installed exterior to the water pipe, parallel to the piston's axis of movement. The metal reed switch sensor opens or closes depending on the piston's position within the pipe.

Such reed switches have their disadvantages. Foremost, to protect the switch, the reed switch is placed in a sealed glass capsule-like container. Glass is needed because of its magnetically neutral properties. The glass container may be housed in a thin brass sleeve for attachment to the water pipe. Of course, the glass container is prone to breakage. In fact, the glass container is sometimes damaged even during shipping. If shipping doesn't break the glass container, installing the switch can break it. Often, the reed switch within the glass container is attached to the brass sleeve or water pipe with a set screw. If this set screw is overly tightened, the glass container breaks. Even after installation, a reed switch remains prone to breakage from undue vibrations in the water pipe or by carelessness of maintenance workers when working near the switch.

Another disadvantage of the reed switches is the calibration needed during installation. The reed switch within its glass container opens and closes based on a magnetic field from the magnet on the piston within the water pipe. On installation, the reed switch must be positioned very precisely so that the switch will open and close properly. If the switch is not calibrated correctly against the piston's magnet, the switch will not be able to correctly sense the flow of water through the pipe. Each time the reed switch is replaced, this calibration must be repeated.

A disadvantage to some of the current reed-type switches is the pressure drop associated with using the switch. Some current switches can cause a pressure drop of between 30 and 45 p.s.i. when the flow rate is at 7 gallons per minute. This pressure drop is an inefficiency that makes a washing system utilizing such switches less desirable.

Because reed-type switches have such disadvantages, there have been various attempts to invent a better flow switch. In one area of development, magnets have been used as part of the switching apparatus. For example, U.S. Pat. No. 4,499,347 to Richards (issued on Feb. 12, 1985) discloses a flow indicator mechanism having a hinged plate, flapper valve. A magnet is attached to the end of the flap to activate a switch. As another example, U.S. Pat. No. 4,963,857 to Sackett (issued on Oct. 16, 1990) discloses magnets tripping both reed switches and microswitches. The magnets are placed on a shaft so that they can move along the shaft by the pressure of the flow of fluid.

While these attempts of incorporating magnets in flow switches offer some improvement over the standard reed-type switches, all of these inventions suffer from one or more deficiencies. Some prior magnetic switches utilize complex components to activate the switch mechanism, including small components that must be tooled or machined. Others need many additional components in assembly to monitor fluid flow. With additional moving parts and added complexity, such prior art switches are more susceptible to contamination and operation under extreme conditions. Many of the prior devices also had sensitivity issues concerning the amount of flow and pressure needed to activate them.

It would be desirable to manufacture a switch that alleviates the disadvantages of the current flow switches. It would be desirable to have such a switch not encased in glass or other fragile material so that the switch could be quite dependable and rugged. It would also be desirable to have the switch operate reliably with as few mechanical parts as possible, particularly in the fluid passageway, as those parts are most susceptible to damage. A switch which can self-calibrate or self-align would be quite advantageous, especially if this alignment could be accomplished without a mechanical guide. In addition, it would be advantageous to have a flow switch in which the switching element is compartmentalized out of the fluid flow path. This would eliminate a potential seal breach resulting in switch failure.

SUMMARY OF THE INVENTION

The present invention is a in-line flow switch for a high-pressure washing system or other flow-related system. The in-line flow switch can be configured to be normally in the open position and triggered by the flow of water or other fluid through a pipe. Alternatively, the in-line flow switch can be configured to be normally in the closed position, but opened by the flow of water or other fluid through a pipe.

The flow switch includes a housing with an inlet and outlet port. The housing is connected to a pipe system so that fluid flows from the pipe into the inlet port, through the housing, out the outlet port, and continues along the pipe.

Within the housing is a plunger which is sensitive to flow through the housing. A plunger magnet is attached to the plunger. External to the housing is situated a sensor (such as a microswitch) having a sensor magnet attached. The sensor magnet and plunger magnet are configured so they oppose one another. Thus, when flow is absent in the housing, the plunger magnet and thus the plunger are moved away from the sensor magnet. When flow is present in the housing, the repellent magnetic force of the magnets are overcome by the flow and the plunger moves to a position within the chamber and the plunger magnet activates the sensor. The sensor is configured to react to the dual positions of the plunger. In this way, the sensor can indicate when flow is or is not present. In some embodiments, a display unit (such as an LED unit) is also electrically connected to the sensor so that the display unit visually indicates whether there is flow in the housing.

In some advanced embodiments, there is a third magnet, known as the alignment magnet. The alignment magnet is positioned near the housing so that it naturally attracts the plunger magnet. This attraction properly orients the plunger magnet so that it can successfully interact with the sensor magnet and sensor to cause the sensor to open and close as appropriate.

The flow switch assembly advantageously is made up of inexpensive, non-magnetic durable materials, without the need for a reed switch's use of glass. An advantage of the present invention is that when the flow switch assembly is installed, the calibration procedure needed with prior reed switches is eliminated as the alignment magnet will automatically orient the plunger magnet. The use of the sensor magnet and plunger magnet also allows the flow switch to be built without the need for a spring to move the plunger in the absence of flow.

DESCRIPTION OF THE DRAWINGS

FIG. 1B also shows sectional line 1C—1C.

DETAILED DESCRIPTION OF THE INVENTION

The present invention is a in-line flow switch assembly for a high-pressure washing system or other flow-related system. Throughout the drawings, an attempt has been made to label corresponding elements with the same element numbers. The element numbers include:

| Reference # | Element |
|---|---|
| 1 | housing |
| 2 | enclosure |
| 3 | lever |
| 4 | plunger |
| 5 | plunger magnet |
| 6 | sensor |
| 7 | plunger retainer |
| 8 | wire assembly |
| 9 | sensor magnet |
| 10 | display unit |
| 11 | alignment magnet |
| 12 | inlet port |
| 13 | outlet port |
| 14 | screw |
| 15 | sensor magnet cap |

Figure 1:
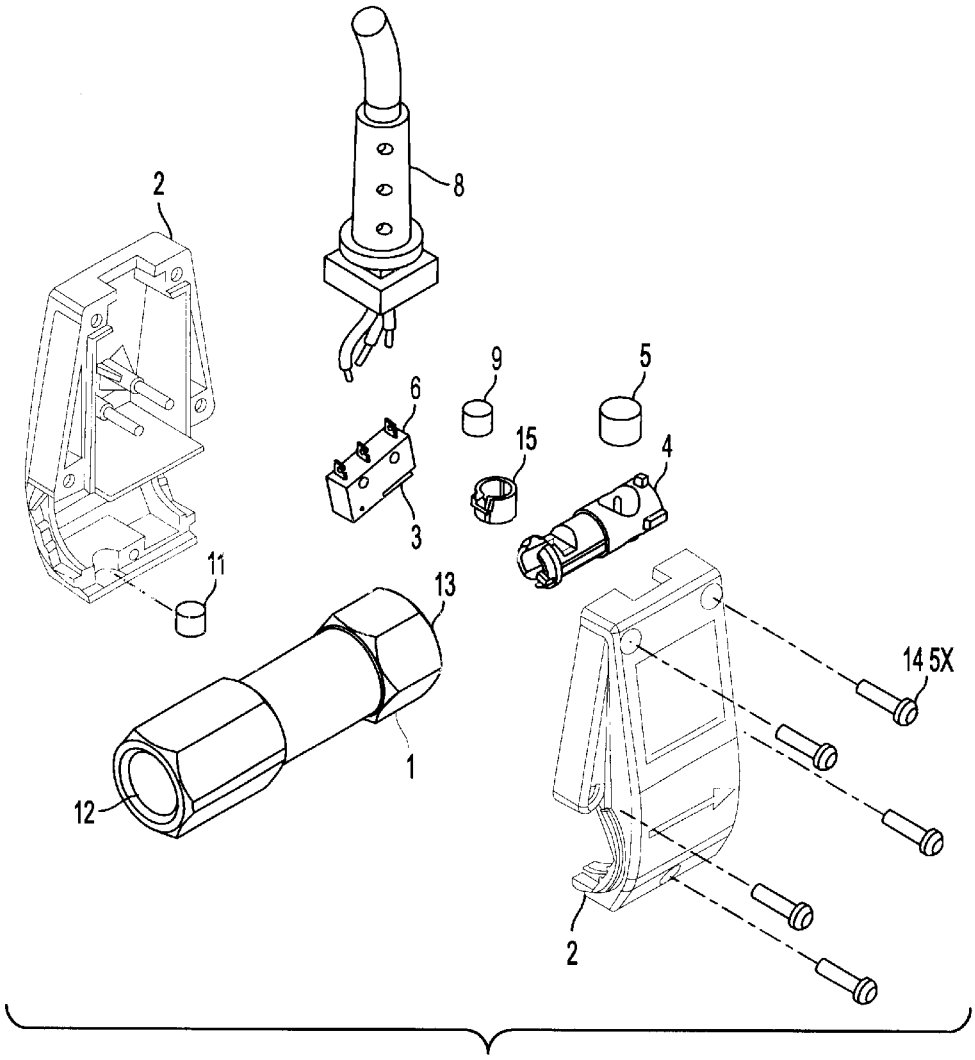
FIG. 1 is an exploded diagram of the flow switch assembly, showing the housing, magnets and other elements.

Referring to the drawings, the invention will now be described. The invention is made up of several interconnected elements, some of which are optional. FIG. 1 shows an exploded view of the in-line flow switch assembly. The in-line flow switch consists of an enclosure 2 supporting a housing 1. The housing 1 has an inlet port 12 and an outlet port 13. Wire assembly 8 is electrically connected to sensor 6. In some embodiments, sensor 6 includes a lever 3 which, when depressed, triggers the sensor. Enclosure 2 can also assist in maintaining wire assembly 8 and sensor 6 in proper position to the housing 1. In some embodiments, a display unit 10 is also electrically connected to the sensor 6 or wire assembly 8.

A plunger 4 is placed within the housing 1. A plunger magnet 5 is connected to the plunger 4 via a recess in plunger 4. A second magnet, the sensor magnet 9, is placed in communication with the sensor 6. In some embodiments, a sensor magnet cap 15 is used to join sensor magnet 9 to the sensor 6. Plunger magnet 5 and sensor magnet 9 are configured so that the magnets oppose one another in polarity. A plunger retainer 7 is installed in the housing, which prevents movement of the plunger 4 past a certain point. Some embodiments include a third magnet. This alignment magnet 11 is placed proximately to the housing 1 and directly opposite sensor magnet 9. If the third magnet is not used other means must be used to hold the plunger into position when no flow is present. A spring or positioning of the device to allow gravity to hold the plunger 4 in place could be used. Allowances must also be made in the housing 1 and plunger 4 to align the plunger magnet 5 and sensor magnet 9.

The in-line flow switch of the present invention operates to detect the presence or absence of flow of water or other liquid within a fluid-carrying pipe system. The housing 1 of the present invention is incorporated into the pipe system such that fluid can flow from the pipe system into the housing 1 through the inlet port 12. The fluid exits the housing 1 by way of the outlet port 13.

When there is no fluid flow through housing 1, the in-line flow switch is at its rest position. When water or other fluid enters housing 1, the fluid presses against plunger 4. Once flow increases to threshold level—which may be approximately 0.1 gallons per minute in some embodiments—the fluid moves plunger 4 to its active position against plunger retainer 7. Plunger retainer 7 ensures that plunger 4 cannot be carried by the fluid out of housing 1 through the outlet port 13 and that plunger 4 stays in specified magnetic field. As plunger 4 is moved to its active position by the fluid, plunger magnet 5 repels sensor magnet 9, which causes the sensor lever 3 or other triggering device to activate sensor 6. Wire assembly 8 transmits the triggering of the sensor 6 to some other subsystem. For example, wire assembly 8 can be electrically connected to a burner unit of a high pressure washing system so that the burning unit is turned on only when flow is present in housing 1. In some embodiments, a display unit 10, such as an LED display, is incorporated into the in-line flow switch so that operators and maintenance crew can visually detect when flow is present in housing 1.

As long as there is sufficient flow, plunger magnet 5 keeps sensor 6 triggered. However, when the flow drops below a threshold level—which again may be approximately 0.1 gallons per minute—the fluid force being applied to plunger decreases enough so that plunger 4 moves back to its rest position. At such a time, lever 3 moves and deactivates the sensor 6.

In some embodiments, a third magnet is used. In such a system, the alignment magnet 11 is situated proximate to the housing 1 so that the plunger magnet 5 is located between the sensor magnet 9 and the alignment magnet 11. The sensor magnet 9 is magnetically opposed to the plunger magnet 5 while the alignment magnet 11 is directly magnetic to the plunger magnet 5. The alignment magnet 11 is magnetically equal or stronger than the sensor magnet 9, causing the plunger magnet 5 (and hence plunger 4) to be attracted to the alignment magnet 11 when there is no fluid flow. In this way, alignment magnet 11 properly orients plunger magnet 5 within housing 1. When flow is present, fluid forces push plunger 4 towards sensor magnet 5, causing sensor 6 to be activated. When flow later decreases, alignment magnet 11 ensures plunger 4 is correctly returns to its resting position in preparation for a subsequent flow.

Of course, the in-line flow switch can be configured to be normally in the open position and triggered by the flow of water or other fluid through a pipe, or it can be configured to be normally in the closed position, but opened by the flow of water or other fluid through a pipe.

There are numerous ways to execute the construction of the present invention's in-line flow switch. Housing 1 can be constructed from brass, specifically, brass C360 per ASTMB-16. The inlet port 12 and outlet port 13 can be configured with threads for receiving a ⅜ inch pipe. Of course other dimensions and fabrications for housing 1 can also be used and in some embodiments, housing 1 may be constructed so that enclosure 2 is not necessary.

The magnets, including plunger magnet 5, sensor magnet 9, and alignment magnet 11 may be made of nickel plated neodymium. The plunger 4 can be formed from acetyl, but could be made from a nonmetallic metal or other plastic material. In one preferred embodiment, plunger retainer 7 is made from copper (per ASTM B-16) or a nonmagnetic metal or plastic material.

In one embodiment, the in-line flow switch is assembled by inserting the sensor into enclosure 2. The wire assembly 8 is attached to sensor 6 by soldering, crimping or other method. Sensor magnet 9 can be attached to lever 3 using adhesive. Lever 3 could also be configured to hold the sensor magnet in place. The sensor magnet 9 could also be encapsulated in sensor magnet cap 15 and mechanically attached to the lever 3. The plunger magnet 5 is secured in the magnet recess of plunger 4 with an adhesive, such as a rubber or acrylic adhesive manufactured by 3M. (Of course there are other ways in which the plunger 4 and plunger magnet 5 can be connected. For example, the plunger 4 could be injection molded so that the plunger magnet 5 is well seated within the magnet recess. Or the plunger 4 could be designed with another shape which would ensure plunger magnet 5 remains closely connected to plunger 4.) Once the adhesives have cured, the in-line flow switch can be fully assembled. Plunger 4 with the attached plunger magnet 5 is inserted within the housing 1. The plunger retainer 7 is a retaining clip pressed into a groove to secure the plunger 4 and plunger magnet 5. The plunger retainer 7 could also be threaded or pressed in place. The alignment magnet 11 and sensor magnet 9 are positioned along the housing 1, as is the display unit 10, sensor 6 and wire assembly 8. Enclosure 2 can be used to maintain the position of these elements with respect to housing 1. In some embodiments, housing 1 may be constructed to alignment magnet 11. Water lines (or lines for other fluids) are attached to the housing inlet port 12 and housing outlet port 13.

Figure 1C:
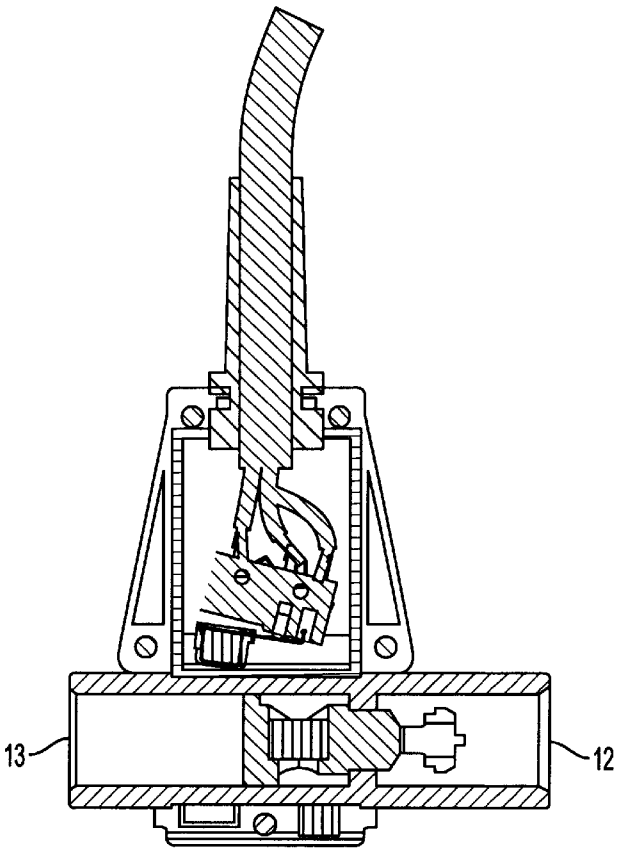
FIG. 1C is a cross-sectional view of the flow switch assembly as viewed along FIG. 1B's sectional line 1C—1C.
Figure 1B:
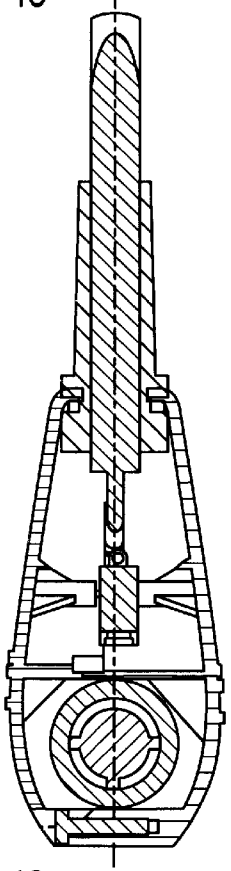
FIG. 1B is a cross-sectional view of the flow switch assembly as viewed along FIG. 1A's sectional line 1B—1B.
Figure 1A:
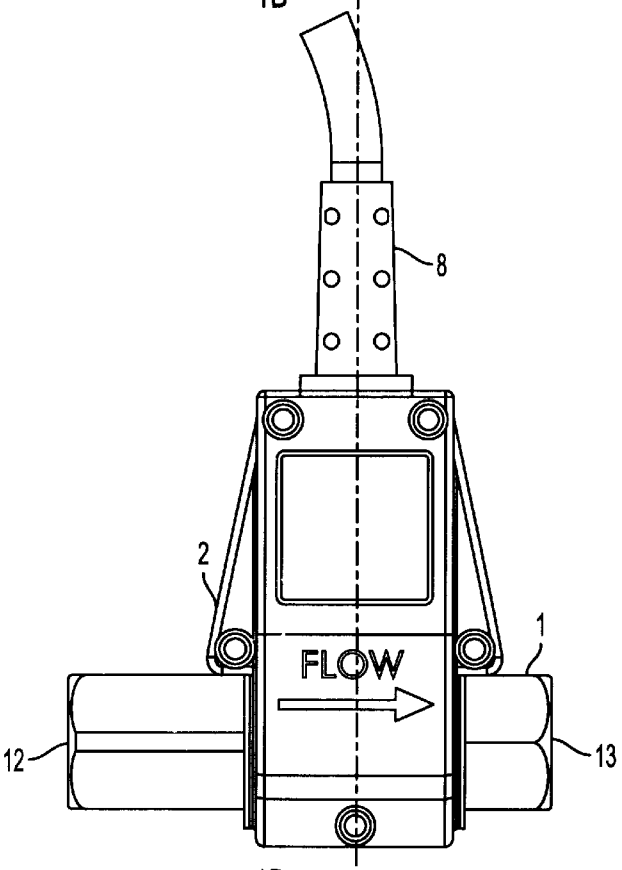
FIG. 1A is a side plan view of the flow switch assembly, with a sectional line 1B—1B.

Returning to the figures, FIG. 1A is a side plan view of the flow switch assembly, with a sectional line A—A. FIG. 1B is a cross-sectional view of the flow switch assembly as viewed along FIG. 1A's sectional line A—A and including sectional line B—B. FIG. 1C is a cross-sectional view of the flow switch assembly as viewed along FIG. 1B's sectional line B—B.

Figure 3:
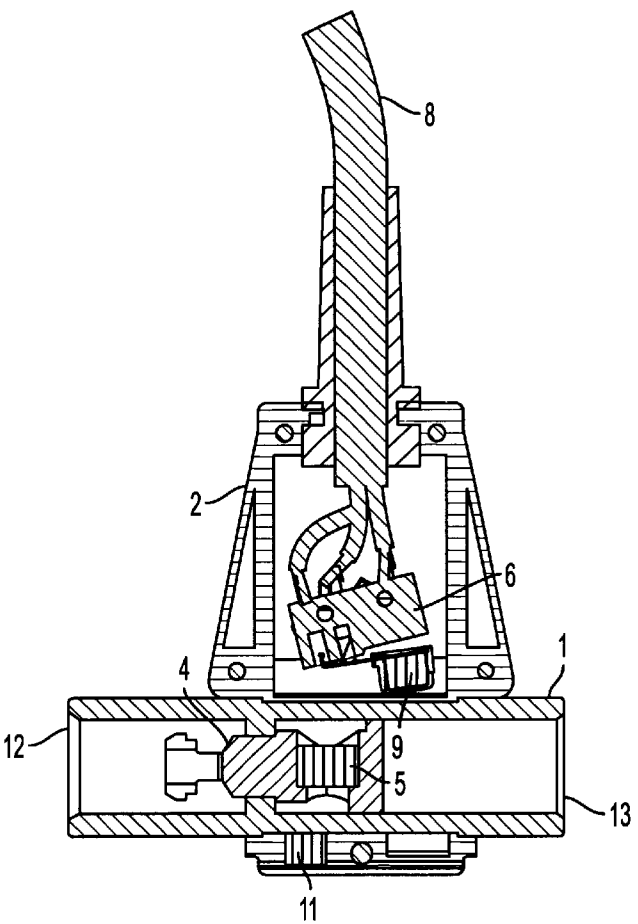
FIG. 3 is a cross-sectional view of the flow switch assembly as viewed along FIG. 2's sectional line 3—3, showing the plunger in its closed position due to an absence of fluid flow.
Figure 2:
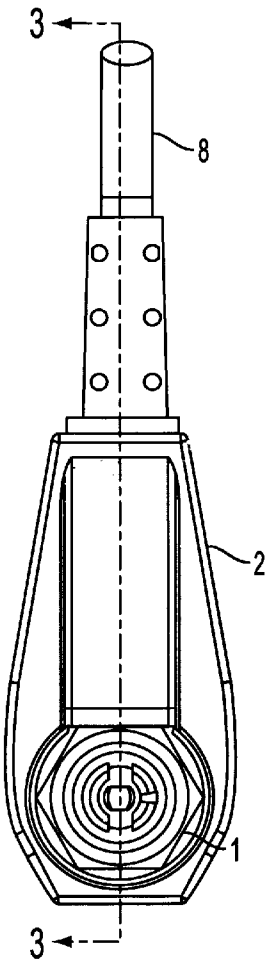
FIG. 2 is a front plan view of the flow switch assembly, with a sectional line 3—3.
Figure 5:
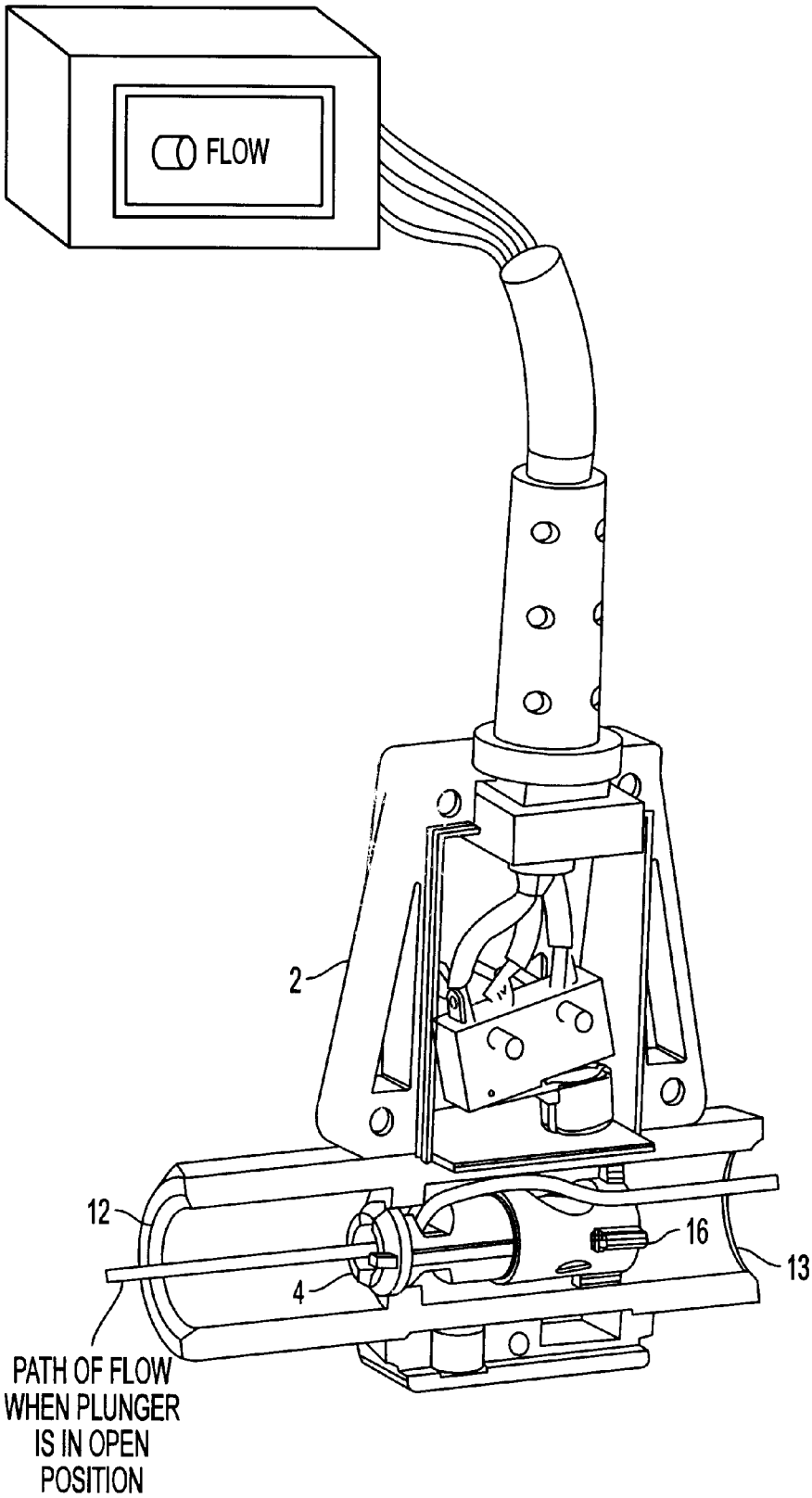
FIG. 5 is a cross-sectional view of the in-line flow switch assembly showing the path of fluid flow when plunger is in its open position.

FIG. 2 is a front plan view of the assembled flow switch assembly, with a sectional line D—D. FIG. 3 is a cross-sectional view of the flow switch assembly as viewed along FIG. 2's D—D line, showing the plunger at its rest position in the absence of fluid flow. Notice in FIG. 3 that plunger magnet 5 repels sensor magnet 9. The magnetic force is not strong enough to move sensor magnet 9 and activate sensor 6. In the embodiment shown in FIG. 3, the optional alignment magnet 11 is present, which attracts plunger magnet 5, to properly align plunger 4. The plunger 5 is held in position due to the magnetic attraction between the plunger magnet 5 and the alignment magnet 11 being greater than the opposing magnetic force between the plunger magnet 5 and sensor magnet 9.

Figure 4:
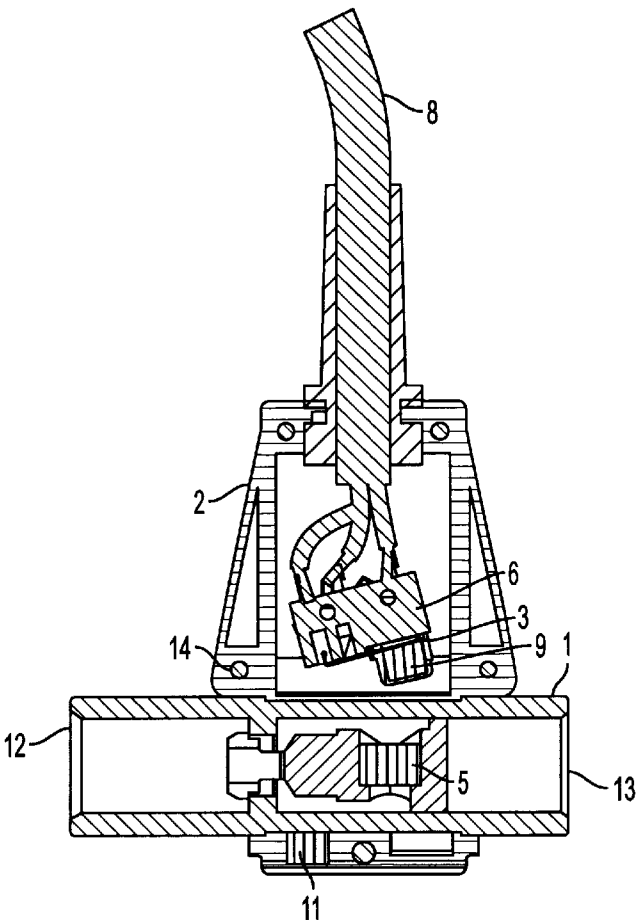
FIG. 4 is a cross-sectional view of the in-line flow switch assembly as viewed along FIG. 2's sectional line 3—3, showing the plunger in its open position with fluid flow present.

FIG. 4 is a cross-sectional view of the in-line flow switch assembly as viewed along FIG. 2's D—D line, showing the action of plunger 4 when fluid flow is present. Notice that the fluid flow entering through the inlet port 12 has overcome the attraction between the alignment magnet 11 and plunger magnet 5 as well as the repelling force of plunger magnet 5 with sensor magnet 9. The fluid flow has moved plunger 4 to its second active position within housing 1, against plunger retainer 7. In this position, plunger magnet 5 has caused lever 3 to trigger sensor 6.

There are numerous advantages to the present invention. By replacing the traditional reed switch with a microswitch, the in-line flow switch is more durable and reliable. The present invention is more durable than the reed switches currently used in the high-pressure washing system industry because this type of switch does not require a glass container. Instead, the switch is made from plastic and other durable, yet economical, products. The switch functions properly at high pressure. The use of an alignment magnet enables the plunger to return to its resting position without the need for a spring or other means. The use of magnets also allows the in-line flow switch to be easily manufactured and installed as the plunger is self aligning. This dispenses with the need for exact alignment by the person installing the switch. It also eliminates the need for a mechanical guiding element within the switch. This reduces the wear on the switch and the likelihood that the switch will jam.

While the in-line flow switch of the present invention has been mentioned in relation to its use in a high-pressure washing system, it can also be used in many other applications. While previously in-line flow switches were rated at 0.2 ampere service due to the limitations imposed by reed-type switches, the switch of the present invention is capable of 3 ampere, 15 ampere or even higher ratings. The switch can also be installed for larger water (or other fluid) pipes than was possible with traditional reed-type switches or earlier flow switches. For with the proper strength of magnets, the housing 1 could be 24 inches or even more. Also as the invention has a flow-through design, the fluid travels through housing 1 in a straight line, resulting in reduced pressure drop and an improvement in performance.

One embodiment of the present invention is rated at up to 5,000 p.s.i. The present invention operates efficiently causing a minimal pressure drop in flows from 0.5 gallons per minute to 12.0 gallons per minute. Of course, the design can be enlarged or reduced to encompass different flows.

This invention has advantages over traditional microswitch activated designs in that no alignment features are needed for the plunger 4, no fluid seals are needed between the housing 1 and sensor 6 as there is no direct mechanical contact needed to activate the sensor 6.

Although the present invention has been described with reference to the preferred embodiments, workers skilled in the art will recognize that changes may be made in form and detail without departing from the spirit and scope of the invention.

What is claimed is:

1. A flow switch assembly that operates with magnets, comprising:

a housing with a tubular bore, an inlet port and an outlet port for allowing fluid to flow from the inlet port through the tubular bore and exit from the outlet port;

a wire assembly electrically connected to a sensor, the wire assembly and sensor positioned externally to, but in close proximity to the housing;

a sensor magnet in cooperation with the sensor;

a plunger positioned within the tubular bore of the housing, the plunger positionally responsive to fluid flow through the tubular bore, the plunger having a plurality of radial projections for stabilizing the movement of the plunger within the tubular bore of the housing while allowing fluid to pass along the length of the plunger as the fluid flows from the inlet port to the outlet port;

a plunger magnet joined to the plunger, wherein the plunger magnet magnetically opposes the sensor magnet, wherein the plunger is moved by fluid force to a second position in the tubular bore when flow is present causing a magnetically opposing field between the plunger magnet and the sensor magnet to activate the sensor; and an alignment magnet attached proximate to the housing, the alignment magnet and the plunger magnet having opposite magnetic polarity, the plunger magnet magnetically equal or stronger than the sensor magnet, for causing the plunger and plunger magnet to remain proximate to the alignment magnet in a first position when no flow is present until fluid force overcomes the attractive magnetic force between the plunger magnet and the alignment magnet and moves the plunger to the second position;

wherein the sensor indicates whether fluid is flowing through the tubular bore of the housing based on the plunger being in the first or the second position;

wherein plunger magnet is located between the sensor magnet and alignment magnet.

2. The flow switch assembly of claim 1, wherein the sensor is a microswitch having a lever, and wherein the magnetically opposing field between the plunger magnet and the sensor magnet engage the lever to activate the microswitch.

3. The flow switch assembly of claim 1, further comprising a plunger retainer positioned within the housing, for limiting the movement of the plunger when the plunger is moved to the second position when flow is present;

wherein the plunger retainer ensures the plunger remains in the housing; and wherein the plunger retainer keeps the plunger in the correct position in the magnetically opposing field for keeping the sensor activated.

4. The flow switch assembly of claim 1, further comprising an enclosure for securing the sensor and wire assembly to the housing.

5. The flow switch assembly of claim 1, wherein the sensor is normally closed.

6. The flow switch assembly of claim 1, wherein the sensor is normally open.

7. The flow switch assembly of claim 1, further comprising a display unit electrically connected to the sensor for visually indicating when flow is present.

8. The flow switch assembly of claim 7, wherein the display unit is an LED unit.

* * * * *